US008757117B2

(12) United States Patent
Schaefer et al.

(10) Patent No.: US 8,757,117 B2
(45) Date of Patent: Jun. 24, 2014

(54) VALVE DRIVE OF AN INTERNAL COMBUSTION ENGINE HAVING AN ADJUSTMENT DEVICE

(75) Inventors: Jens Schaefer, Herzogenaurach (DE); Sebastian Zwahr, Obermichelbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 276 days.

(21) Appl. No.: 13/202,870

(22) PCT Filed: Feb. 11, 2010

(86) PCT No.: PCT/EP2010/051712

§ 371 (c)(1),
(2), (4) Date: Aug. 23, 2011

(87) PCT Pub. No.: WO2010/097295

PCT Pub. Date: Sep. 2, 2010

(65) Prior Publication Data

US 2011/0303172 A1 Dec. 15, 2011

(30) Foreign Application Priority Data

Feb. 26, 2009 (DE) ..... 10 2009 010 407

(51) Int. Cl.
*F01L 1/34* (2006.01)

(52) U.S. Cl.
USPC ..... 123/90.18

(58) Field of Classification Search
USPC ..... 123/90.15, 90.17, 90.18
See application file for complete search history.

(56) References Cited

U.S. PATENT DOCUMENTS

| | | | | |
|---|---|---|---|---|
| 4,601,266 | A * | 7/1986 | Oldfield et al. | 123/90.15 |
| 5,329,895 | A * | 7/1994 | Nishida et al. | 123/90.17 |
| 5,381,764 | A * | 1/1995 | Fukuma et al. | 123/90.17 |
| 6,216,654 | B1 * | 4/2001 | Regueiro | 123/90.15 |
| 2003/0051687 | A1 * | 3/2003 | Walters | 123/90.18 |

FOREIGN PATENT DOCUMENTS

| | | | |
|---|---|---|---|
| DE | 29 30 266 | A1 | 2/1981 |
| DE | 102 48 351 | A1 | 4/2004 |
| DE | 10 2007 000 809 | A1 | 4/2008 |
| EP | 1 030 036 | A2 | 8/2000 |
| JP | 2003 003 811 | A | 1/2003 |
| WO | 01/71167 | A1 | 9/2001 |

* cited by examiner

*Primary Examiner* — Thomas Denion
*Assistant Examiner* — Daniel Bernstein
(74) *Attorney, Agent, or Firm* — Davidson, Davidson & Kappel, LLC

(57) ABSTRACT

A valve drive for controlling gas exchange valves of an internal combustion engine. The valve drive has at least one valve camshaft that is supported within a cylinder head of the engine and that can be moved in rotation by a drive disk and an adjustment device, which has an adjustment motor and a gear train. The adjustment device provides for an axial movement and/or rotation of the valve camshaft relative to the drive disk in a specific manner upon actuation of the adjustment motor and by the intermediately connected gear train in order to vary in a specific manner an actuation of the gas exchange valves that occurs by cams of the valve camshaft. Also, the adjustment motor is placed predominantly or completely within a common chamber with the drive disk.

11 Claims, 3 Drawing Sheets

VALVE DRIVE OF AN INTERNAL COMBUSTION ENGINE HAVING AN ADJUSTMENT DEVICE

CROSS-REFERENCE TO RELATED APPLICATIONS

This application is a 371 of PCT/EP2010/051712 filed Feb. 11, 2010, which in turn claims the priority of DE 10 2009 010 407.0 filed Feb. 26, 2009. The priority of both applications is hereby claimed and both applications are incorporated by reference herein.

FIELD OF THE INVENTION

The invention relates to a valve drive for controlling gas exchange valves of an internal combustion engine.

BACKGROUND OF THE INVENTION

Combustion engines operating according to the four stroke principle customarily have gas exchange valves in the form of inlet and outlet valves in order to be able to carry out the gas exchange required for operating the internal combustion engine. Opening and closing movements of the particular valves are initiated here via cams of an associated valve camshaft.

In the sphere of spark ignition engines, use is furthermore customarily made of adjustment devices via which the timings of the gas exchange valves can be displaced by means of rotation of the valve camshaft and can therefore be adapted to different rotational speeds and cylinder fillings of the internal combustion engine. This makes it possible to increase the quality of the gas exchange.

DE 102 48 351 A1 discloses a valve drive for controlling gas exchange valves of an internal combustion engine, in which a valve camshaft which is mounted within a cylinder head of the internal combustion engine can be set into rotation via a driving disk. In this case, an adjustment device is provided on the end side of the valve camshaft, which adjustment device has an adjustment motor, which is located in an additional housing outside the cylinder head, and a gearing, wherein the adjustment motor is connected to the valve camshaft via the gearing located in between. When the adjustment motor is actuated, relative rotation of the valve camshaft with respect to the driving disk can be achieved by means of the gearing, which leads to a displacement of the actuation of the gas exchange valves taking place via cams of the valve camshaft.

However, an arrangement of this type has the disadvantage that the internal combustion engine requires a greater amount of space because of the adjustment motor provided in the additional housing on the cylinder head.

It is therefore the object of the present invention to make available a valve drive for controlling gas exchange valves of an internal combustion engine, which valve drive has an adjustment device arranged as compactly as possible to provide a reduced overall length of the internal combustion engine.

SUMMARY OF THE INVENTION

The invention relates to a valve drive for controlling gas exchange valves of an internal combustion engine having a cylinder head, the valve drive, which comprises a driving disk arranged in a chamber of the cylinder head of the internal combustion engine; at least one valve camshaft, which is mounted within the cylinder head of the internal combustion engine and can be set into rotation via the driving disk, having cams; and an adjustment device having an adjustment motor and a gearing, the adjustment device ensures an axial displacement and/or rotation of the at least one valve camshaft relative to the driving disk in a specific manner when the adjustment motor is actuated by the interconnected gearing in order to specifically vary an actuation of the gas exchange valves, which occurs via the cams of the at least one valve camshaft, wherein the adjustment motor is placed predominantly or completely within the chamber of the cylinder head of the internal combustion engine with the driving disk. The adjustment motor of the adjustment device is placed predominately or completely within a common chamber with the driving disk. By integration of the adjustment motor in the chamber of the driving disk, the overall length of the internal combustion engine can be reduced and, in addition, additional housing parts for encapsulating the adjustment motor can be managed without. It will be clear here to a person skilled in the art that, depending on the configuration of the internal combustion engine, the chamber of the driving disk may be the cylinder head or a chain guard or belt guard.

According to one refinement of the invention, the cams of the valve camshaft have a cam lift which is variable in the axial direction. By means of said "three-dimensional cams" and an adjustment device which can bring about an axial displacement of the valve camshaft, in addition to a change in phase position the strokes of the associated gas exchange valves can be varied. Accordingly, the activation of the gas exchange valves can be matched even more precisely to the required quantity of mixture for dethrottling the internal combustion engine.

In a development of the invention, the gearing of the adjustment device comprises a nut connected fixedly to one end of the valve camshaft and a spindle connected to the adjustment motor, and is supported via an axial bearing unit on a driving constructional unit which bears the driving disk. In this case, relative rotation, which is introduced via the adjustment motor, of the spindle with respect to the driving disk is converted into an axial displacement of the nut. Such a configuration of the gearing has the substantial advantage that the relative rotation, which is produced by the adjustment motor, with respect to the driving disk is converted in a compact and low-friction manner into an axial displacement of the valve camshaft. Furthermore, axial forces which are introduced into the gearing by the valve camshaft can be reliably absorbed by means of the axial bearing unit provided.

According to an advantageous embodiment of the invention, the axial displacement of the nut in both directions can be limited by axial stops which are each connected fixedly to the cylinder head. This makes it reliably possible in a simple manner to prevent damage to the gearing as a consequence of excessive axial advancing of the nut.

An alternative refinement of the invention involves the axial displacement of the nut in both directions being able to be limited by radial stops which are each placed in a fixed position on the spindle and, beyond a defined position, enter into contact with respective projections provided on the nut. A limitation designed in such a manner of the axial adjustment path of the nut has the advantage that no additional forces are exerted upon contact of the radial stops together with the nut with the mountings of the components involved.

In a development of the invention, the axial bearing unit is designed in the manner of a prestresed rolling bearing which acts on two sides. This measure can result in a low-friction and robust axial mounting of the gearing.

According to a further advantageous refinement of the invention, a coupling in the form of a cross slide coupling is provided between the spindle and adjustment motor. By this means, it is advantageously possible for radial and axial manufacturing and installation tolerances between the two components to be reliably compensated for. However, it will be clear to a person skilled in the art that other types of couplings may also be used for this purpose.

In a development of the invention, at least one guide body is placed in the radial direction between the valve camshaft and the driving constructional unit which bears the driving disk, which guide body runs in guide tracks, which are provided on the valve camshaft and on the driving constructional unit, correspond to each other and run helically and, upon an axial displacement of the valve camshaft, brings about the relative rotation of said valve camshaft with respect to the driving constructional unit. By means of such an arrangement, upon an axial displacement of the valve camshaft a defined relative rotation of the valve camshaft with respect to the driving disk can be achieved at the same time in a manner corresponding to the configuration of the guide tracks. The guide body is advantageously a ball as also used as rolling bodies in low-friction ball bearings.

With regard to the axial construction space requirement of the driving unit and gearing, it is particularly favorable if the spindle and the guide tracks overlap axially predominantly or completely.

In a development of the invention, the adjustment motor is designed in the manner of an electric motor. This enables precise control of the gearing of the adjustment device to be realized overlap axially.

A further advantageous embodiment of the invention involves the driving disk being designed as a chain disk. Accordingly, robust and precise driving of the valve camshaft is possible.

Further measures improving the invention are illustrated in more detail below together with the description of preferred embodiments of the invention with reference to the figures.

DETAILED DESCRIPTION OF THE INVENTION

Figure 1:
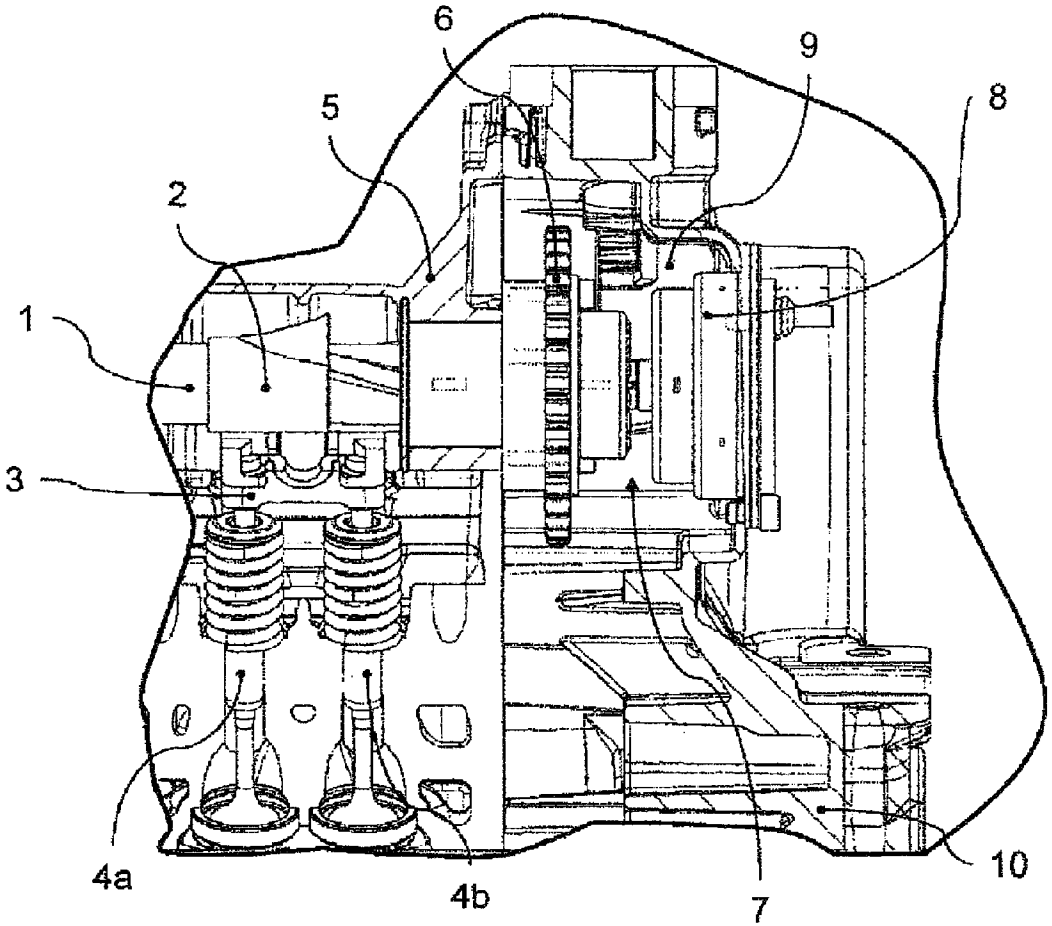
FIG. 1 shows a detailed sectional view of the valve drive according to the invention, in the region of one end of the valve camshaft.

FIG. 1 illustrates a detailed sectional view of the valve drive according to the invention in the region of one end of a valve camshaft 1. Said valve camshaft 1 has a plurality of cams 2 which, in detail, are operatively connected in each case via an actuating device 3 to two associated gas exchange valves 4*a* and 4*b*. The valve camshaft 1 is furthermore mounted rotatably in a cylinder head 5 of the internal combustion engine and, at its one end, has a driving disk 6 which, in this case, is designed as a chain disk and via which said valve camshaft is connected to a crankshaft of the internal combustion engine by means of a chain (not illustrated here). When the internal combustion engine is in operation, the valve camshaft 1 is driven by means of said driving disk 6 via the crankshaft and in this case uses its cams 2 to actuate the respectively associated gas exchange valves 4*a* and 4*b*. The cams 2 are "three-dimensional cams" which each have a cam lift which is variable in the axial direction. By means of axial displacement the valve camshaft 1 relative to the actuating device 3, the lift of the cam 2 that is transmitted to the gas exchange valves 4*a* and 4*h* via the actuating device 3 is varied in a specific manner. This results in a change in the stroke of the gas exchange valves 4*a* and 4*b*. At the same time, by means of a relative rotation of the valve camshaft 1 with respect to the driving disk 6, a change in the timings of the gas exchange valves 4*a* and 4*b* is achieved, the gas exchange valves 4*a* and 4*b* opening with an earlier or later phase position depending on the direction of rotation of the valve camshaft 1.

In order to control the axial displacements and relative rotations of the valve camshaft 1, an adjustment device 7 with an adjustment motor 8 is provided in the region of the driving disk 6, said adjustment motor being placed together with the driving disk 6 predominantly in a common chamber 9. This is defined by a cover 10 placed directly onto the cylinder head 5. The predominant integration of the adjustment device 7 into the chamber 9 of the driving disk 6 constitutes a particularly compact construction so as to provide a small overall length of the internal combustion engine.

Figure 2:
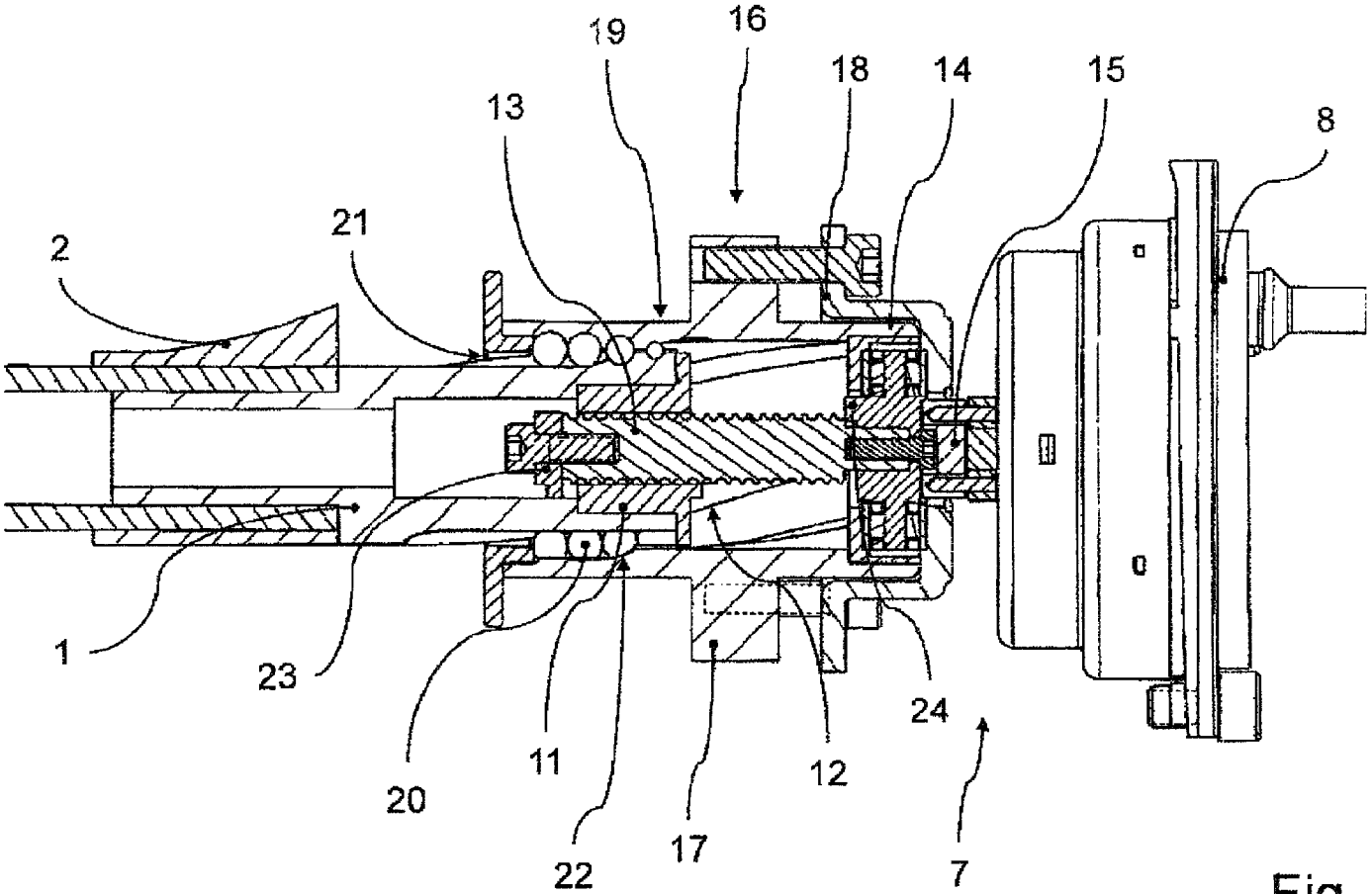
FIG. 2 shows a detailed sectional view of the valve camshaft together with the adjustment device.

For better understanding of the interaction of the valve camshaft 1 with the adjustment device 7, a sectional view of the valve camshaft 1 on sides of the adjustment device 7 without the surrounding cylinder head 5 is illustrated in FIG. 2. As can be seen, the valve camshaft 1 is designed as a hollow shaft and is fixedly connected at the end thereof to a nut 11 of a gearing 12 of the adjustment device 7. The nut 11 is placed with a thread on the inside diameter thereof on a corresponding thread of a spindle 13, wherein rotation of the spindle 13 relative to the nut 11 causes an axial movement of the nut 11 in the corresponding direction. The spindle 13 is connected on the side thereof which faces away from the valve camshaft 1 to the inner ring of an axial bearing unit 14 which is designed as a prestressed rolling bearing acting on two sides. The inner ring of this axial bearing unit 14 can execute a rotation here with respect to the outer ring and is furthermore operatively connected to the adjustment motor 8 via a cross slide coupling 15.

The adjustment motor 8 (not illustrated in section form here) is designed as an electric motor and has, in a known manner, a rotor which is connected to the cross slide coupling 15, and a stator part which is connected to the cover 10. However, it will be clear to a person skilled in the art that the adjustment motor 8 may also be implemented in the form of an alternative actuator, for example in the form of a hysteresis brake. The outer ring of the axial bearing unit 14 is linked fixedly to a driving constructional unit 16 which bears the driving disk 6 (not illustrated here) between a first part 17 and a second part 18 and, in addition, by means of the first part 17 forms the inner ring 19 of a sliding bearing for mounting the valve camshaft 1 in the cylinder head 5.

Guide bodies 20 in the form of halls are placed in the radial direction between the first part 17, which is designed as a hollow shaft, and the valve camshaft 1, said guide bodies running in guide tracks 21 and 22 which are provided on the valve camshaft 1 and on the second part 17 of the driving constructional unit 16 and correspond to each other. Said guide tracks are in each case of helical design and, firstly, thus permit a torque to be transmitted from the driving disk 6 to the valve camshaft 1 by means of the driving constructional unit 16 and, secondly, upon an axial displacement of the valve camshaft 1, bring about a relative rotation of the valve camshaft 1 with respect to the driving constructional unit 16 via the guide bodies 20.

The gearing 12 and the driving constructional unit 16 are arranged nested radially one in the other, the spindle 13 and the guide tracks 21, 22 overlapping axially completely axially.

Figure 3:
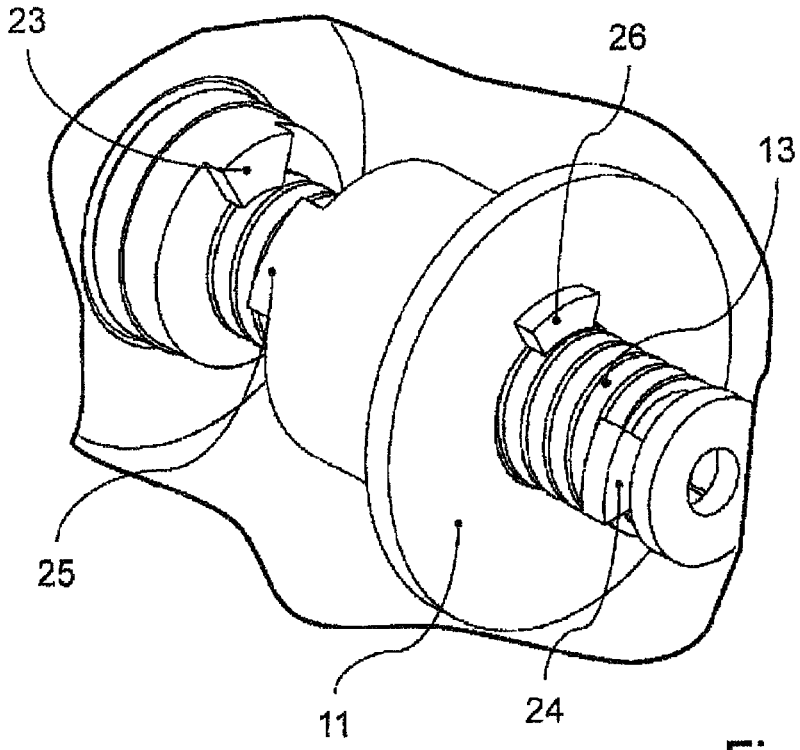
FIG. 3 shows a perspective view of a detail of a gearing of the adjustment device of the valve drive according to the invention according to a first embodiment.

During operation of the internal combustion engine, a torque is transmitted via the driving disk 6 and by means of the driving constructional unit 16 to the valve camshaft 1, wherein the entire gearing 12 and the rotor of the adjustment motor 8 rotate at the same rotational speed. If, by actuation of the adjustment motor 8, the rotation of the motor is then increased or decelerated, this is transmitted to the spindle 13 by means of the cross slide coupling 15. The differential rotational speed thereupon arising between the spindle 13 and nut 11 causes an axial displacement of the nut 11, with the direction of said axial displacement corresponding to the sign of the difference in rotational speed between the spindle 13 and nut 11. During this movement, the nut 11 carries along the valve camshaft 1 which at the same time, owing to the guide tracks 21 and 22 and the guide bodies 20, executes a relative rotation with respect to the driving constructional unit 16. In order, however, to prevent damage to the gearing 12 due to excessive axial displacement of the nut 11, radial stops 23 and 24 placed in a fixed position on the spindle 13 on both sides of the nut 11 are provided, wherein the radial stop 24 is formed by the inner ring of the axial hearing unit 14. Beyond a defined position of the nut 11, the radial stops 23 and 24 enter into contact with respective projections 25 and 26 extending on said nut. For better comprehension, an interaction of said elements is illustrated in more detail in the perspective view of a detail in FIG. 3.

Figure 4:
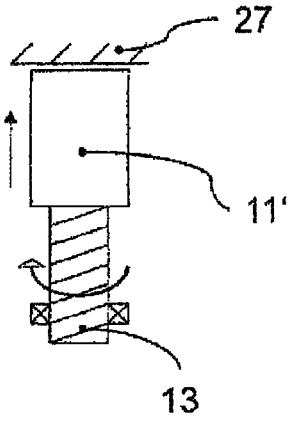
FIG. 4 shows a schematic view of a gearing of the adjustment device of the valve drive according to the invention according to a second embodiment.

FIG. 4 illustrates an alternative possibility for limiting the axial movement of a nut 11'. In contrast to the previously described alternative, an axial displacement, which is caused by the spindle 13, of the nut 11' is brought about by axial stops 27 which are arranged on both sides—only illustrated on one side here—and which are fixedly connected to the cylinder head 5.

LIST OF REFERENCE NUMBERS

1 Valve Camshaft
2 Cam
3 Actuating Device
4*a*, 4*b* Gas Exchange Valves
5 Cylinder Head
6 Driving Disk
7 Adjustment Device
8 Adjustment Motor
9 Chamber
10 Cover
11, 11' Nut
12 Gearing
13 Spindle
14 Axial Bearing Unit
15 Cross Slide Coupling
16 Driving Constructional Unit
17 First Part Driving Constructional Unit
18 Second Part Driving constructional Unit
19 Inner Ring Sliding Bearing
20 Guide Body
21 Guide Track Valve Camshaft
22 Guide Track Driving Constructional Unit
23, 24 Radial Stops
25, 26 Projections Nut
27 Axial Stop

The invention claimed is:

1. A valve drive for controlling gas exchange valves of an internal combustion engine having a cylinder head, the valve drive comprising:

a driving disk arranged in a chamber;

at least one valve camshaft, which is mounted within the cylinder head of the internal combustion engine and can be set into rotation via the driving disk, having cams; and an adjustment device having an adjustment motor and a gearing, the adjustment device ensures an axial displacement and/or rotation of the at least one valve camshaft relative to the driving disk in a specific manner when the adjustment motor is actuated by the gearing in order to vary an actuation of the gas exchange valves, which occurs via the cams of the at least one valve camshaft, wherein the adjustment motor is placed predominantly or completely within the chamber with the driving disk, a driving constructional unit, which bears against the driving disk, having an axial bearing unit, wherein the gearing comprises a nut connected fixedly to one end of the at least one valve camshaft and a spindle connected to the adjustment motor, and the gearing is supported by the axial bearing unit on the driving constructional unit such that a relative rotation, which is introduced by the adjustment motor, of the spindle with respect to the driving disk can be converted into an axial displacement of the nut, and at least one guide body disposed in a radial direction between the at least one valve camshaft and the driving constructional unit, the at least one valve camshaft and the driving construction unit have helical guide tracks that correspond to each other, the guide body runs in the guide tracks, and, upon axial displacement of the at least one valve camshaft, the guide body moves along the guide tracks and effects a relative rotation of the at least one valve camshaft with respect to the driving constructional unit.

2. The valve drive as claimed in claim 1, wherein the cams of the at least one valve camshaft have a cam lift which is variable in an axial direction.

3. The valve drive as claimed in claim 1, further comprising axial stops which are connected fixedly to the cylinder head with the axial displacement of the nut in both axial directions being limited by the axial stops.

4. The valve drive as claimed in claim 1, wherein the axial bearing unit is a prestressed rolling bearing which acts on two sides.

5. The valve drive as claimed in claim 1, wherein a coupling, in the form of a cross-slide coupling, is arranged between the spindle and the adjustment motor.

6. The valve drive as claimed in claim 1, wherein the spindle and the guide tracks are arranged on as to predominantly or completely overlap axially.

7. The valve drive as claimed in claim 1, wherein the at least one guide body is spherical.

8. The valve drive as claimed in claim 1, wherein the adjustment motor is an electric motor.

9. The valve drive as claimed in claim 1, wherein the driving disk is a chain disk.

10. A valve drive for controlling gas exchange valves of an internal combustion engine having a cylinder head, the valve drive comprising:

a driving disk arranged in a chamber;

at least one valve camshaft, which is mounted within the cylinder head of the internal combustion engine and can be set into rotation via the driving disk, having cams;

an adjustment device having an adjustment motor and a gearing, the adjustment device ensures an axial displacement and/or rotation of the at least one valve camshaft relative to the driving disk in a specific manner when the adjustment motor is actuated by the gearing in order to vary an actuation of the gas exchange valves, which occurs via the cams of the at least one valve camshaft, wherein the adjustment motor is placed predominantly or completely within the chamber with the driving disk, a driving constructional unit, which bears against the driving disk, having an axial bearing unit, wherein the gearing comprises a nut connected fixedly to one end of the at least one valve camshaft and a spindle connected to the adjustment motor, and the gearing is supported by the axial bearing unit on the driving constructional unit such that a relative rotation, which is introduced by the adjustment motor, of the spindle with respect to the driving disk can be converted into an axial displacement of the nut, and projections provided on the nut and radial stops which are each placed in a fixed position on the spindle and, beyond a defined position, enter into contact with the projections provided on the nut, and the axial displacement of the nut in both axial directions being limited by the radial stops.

11. An internal combustion engine for driving a motor vehicle, comprising:

gas exchange valves;

a cylinder head;

a valve drive for controlling the gas exchange valves of the internal combustion engine, the valve drive comprising:

a driving disk arranged in a chamber;

at least one valve camshaft, which is mounted within the cylinder head of the internal combustion engine and can be set into rotation via the driving disk, having cams; and an adjustment device having an adjustment motor and a gearing, the adjustment device ensures an axial displacement and/or rotation of the at least one valve camshaft relative to the driving disk in a specific manner when the adjustment motor is actuated by the gearing in order to vary an actuation of the gas exchange valves, which occurs via the cams of the at least one valve camshaft, wherein the adjustment motor is placed predominantly or completely within the chamber with the driving disk, driving constructional unit, which beast against the driving disk, having an axial bearing unit, wherein the gearing comprises a nut connected fixedly to one end of the at least one valve camshaft and a spindle connected to the adjustment motor, and the gearing is supported by the axial bearing unit on the driving constructional unit such that a relative rotation, which is introduced by the adjustment motor, of the spindle with respect to the driving disk can be converted into an axial displacement of the nut, and at least one guide body disposed in a radial direction between the at least one valve camshaft and the driving constructional unit, the at least one valve camshaft and the driving constructional unit have helical guide tracks that correspond to each other, the guide body runs in the guide tracks, and, upon axial displacement of the at least one valve camshaft, the guide body moves along the guide tracks and effects a relative rotation of the at least one valve camshaft with respect to the driving constructional unit.

* * * * *